US006047938A

United States Patent [19]

Mitchell

[11] Patent Number: 6,047,938

[45] Date of Patent: Apr. 11, 2000

[54] BEVERAGE COASTER AND DISPENSER

[76] Inventor: Jerry Mitchell, 757 E. Anamosa #109, Rapid City, S. Dak. 57701

[21] Appl. No.: 09/078,707

[22] Filed: May 14, 1998

[51] Int. Cl.[7] ..... A47B 91/00; A47F 7/00

[52] U.S. Cl. ..... 248/346.11; 211/49.1

[58] Field of Search ..... 248/346.11, 311.2, 248/314, 146; 211/49.1, 41.2; 215/393, 394

[56] References Cited

U.S. PATENT DOCUMENTS

| | | | |
|---|---|---|---|
| 1,541,532 | 6/1925 | Simmons | 229/201 |
| 1,916,238 | 7/1933 | Soffel | 206/561 |
| 1,971,337 | 8/1934 | Collins | 428/66.5 |
| 2,426,995 | 9/1947 | Gibbs | 312/71 |
| 2,915,353 | 12/1959 | Michaelsen | 312/284 |
| 3,847,324 | 11/1974 | Uchanski et al. | 220/737 |
| 4,040,549 | 8/1977 | Sadler | 224/483 |
| 4,441,618 | 4/1984 | Mancini | 211/59.2 |
| 5,024,014 | 6/1991 | Swierczek | 40/310 |
| 5,413,302 | 5/1995 | Ferster | 248/346.11 |

*Primary Examiner*—Ramon O. Ramirez
*Assistant Examiner*—David Heisey
*Attorney, Agent, or Firm*—Kaardal & Associates, PC

[57] ABSTRACT

A beverage coaster removably for adhering to a surface such that the beverage coaster does not cling to a beverage container includes a planar disc having an adhesive on the bottom side. In a preferred embodiment, the adhesive in provided in an arcuate strip positioned proximate the outer perimeter of the planar disc. The arcuate strip forms an arc between about 45 degrees and 225 degrees. A dispenser for a stack of beverage coasters is also provided.

10 Claims, 2 Drawing Sheets

BEVERAGE COASTER AND DISPENSER

BACKGROUND OF THE INVENTION

1. Field of the Invention

The present invention relates to beverage coasters and more particularly pertains to a new beverage coaster for removably adhering to a surface such that the beverage coaster does not cling to a beverage container. The present invention further provides a dispenser for a plurality of stacked beverage coasters according to the present invention.

2. Description of the Prior Art

The use of beverage coasters is known in the prior art. More specifically, beverage coasters heretofore devised and utilized are known to consist basically of familiar, expected and obvious structural configurations, notwithstanding the myriad of designs encompassed by the crowded prior art which have been developed for the fulfillment of countless objectives and requirements.

Known prior art beverage coasters include U.S. Pat. No. 4,953,823; U.S. Pat. No. 4,858,873; U.S. Pat. No. 4,978,566; U.S. Pat. No. 5,018,695; U.S. Pat. No. 5,413,302; U.S. Pat. No. 4,759,525; and PCT Patent No. WO 90/03754.

While these devices fulfill their respective, particular objectives and requirements, the aforementioned patents do not disclose a new beverage coaster. The inventive device includes planar disc having an adhesive on the bottom side.

In these respects, the beverage coaster according to the present invention substantially departs from the conventional concepts and designs of the prior art, and in so doing provides an apparatus primarily developed for removably adhering to a surface such that the beverage coaster does not cling to a beverage container.

SUMMARY OF THE INVENTION

In view of the foregoing disadvantages inherent in the known types of beverage coasters now present in the prior art, the present invention provides a new beverage coaster construction wherein the same can be utilized removably adhering to a surface such that the beverage coaster does not cling to a beverage container.

The general removably adhering to a surface such that the beverage coaster does not cling to a beverage container of the present invention, which will be described subsequently in greater detail, is to provide a new beverage coaster apparatus which has many of the advantages of the beverage coasters mentioned heretofore and novel features that result in a new beverage coaster which is not anticipated, rendered obvious, suggested, or even implied by any of the prior art beverage coasters, either alone or in any combination thereof.

To attain this, the present invention generally comprises planar disc having an adhesive on the bottom side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the removably adhering to a surface such that the beverage coaster does not cling to a beverage container of description and should not be regarded as limiting.

As such, those skilled in the art will appreciate that the conception, upon which this disclosure is based, may readily be utilized as a basis for the designing of other structures, methods and systems for providing a beverage coaster for removably adhering to a surface such that the beverage coaster does not cling to a beverage containers of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage coaster apparatus which has many of the advantages of the beverage coasters mentioned heretofore and many novel features that result in a new beverage coaster which is not anticipated, rendered obvious, suggested, or even implied by any of the prior art beverage coasters, either alone or in any combination thereof.

It is another object of the present invention to provide a new beverage coaster which may be easily and efficiently manufactured and marketed.

It is a further object of the present invention to provide a new beverage coaster which is of a durable and reliable construction.

An even further object of the present invention is to provide a new beverage coaster which is susceptible of a low cost of manufacture with regard to both materials and labor, and which accordingly is then susceptible of low prices of sale to the consuming public, thereby making such beverage coaster economically available to the buying public.

Still yet another object of the present invention is to provide a new beverage coaster which provides in the apparatuses and methods of the prior art some of the advantages thereof, while simultaneously overcoming some of the disadvantages normally associated therewith.

Still another object of the present invention is to provide a new beverage coaster for removably adhering to a surface such that the beverage coaster does not cling to a beverage container.

Yet another object of the present invention is to provide a new beverage coaster which includes a planar disc having an adhesive on the bottom side.

Still yet another object of the present invention is to provide a new beverage coaster that provides sufficient adhesive on the bottom side to counteract suction from condensation collecting around the bottom edge of a beverage container.

Even still another object of the present invention is to provide a new beverage coaster that is easily stored and packaged in a dispenser.

Yet another object of the present invention is to provide an economical beverage coaster that optimizes the display of indicia on the upper surface of the beverage coaster by preventing a beverage container from sticking to the upper surface and obscuring the indicia.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
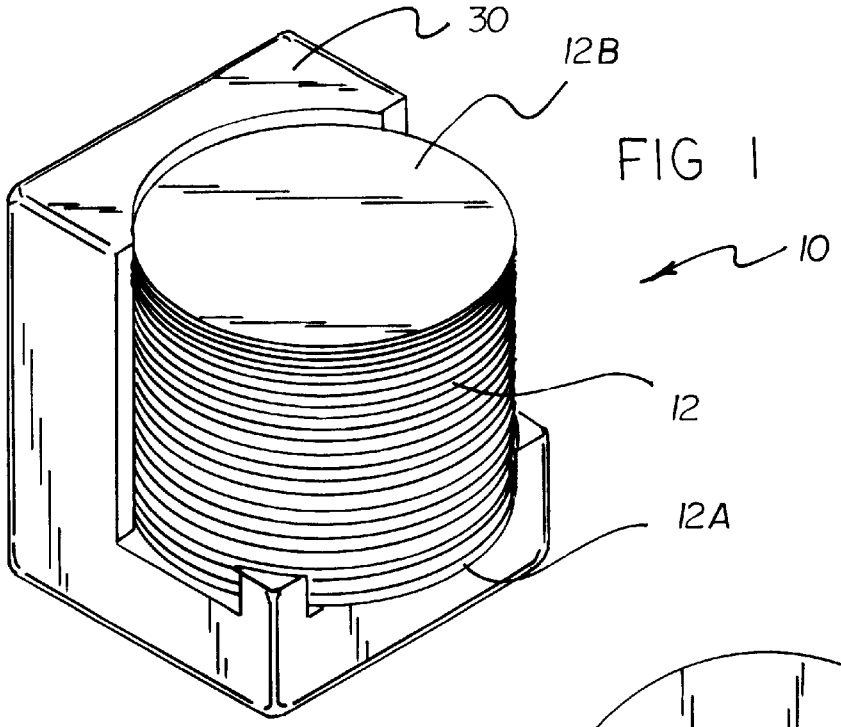
FIG. 1 is a perspective view of a new beverage coaster and dispenser according to the present invention.
Figure 2:
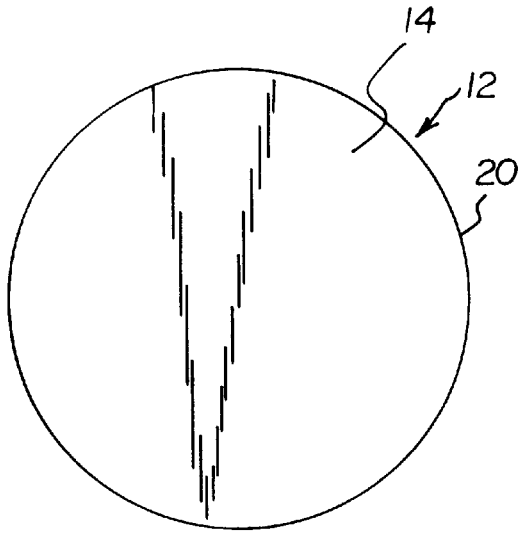
FIG. 2 is a top view of the beverage coaster.
Figure 3:
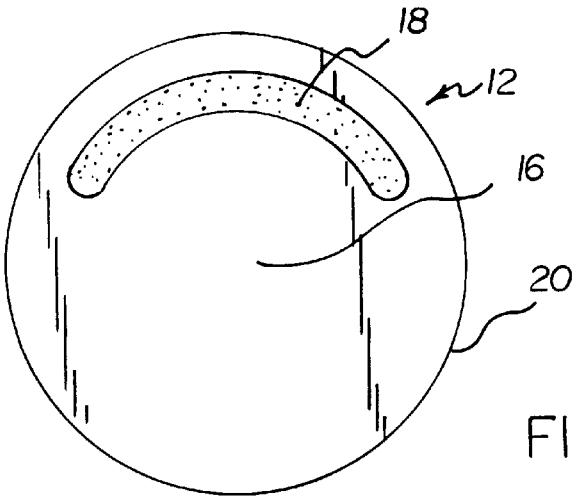
FIG. 3 is a bottom view of the beverage coaster.
Figure 4:
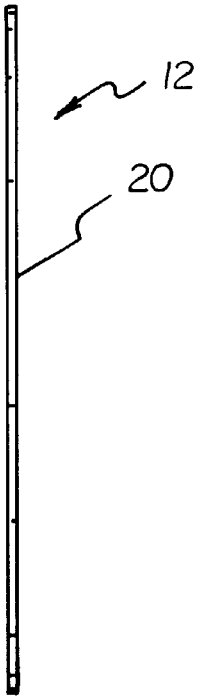
FIG. 4 is a side view of the beverage coaster.
Figure 5:
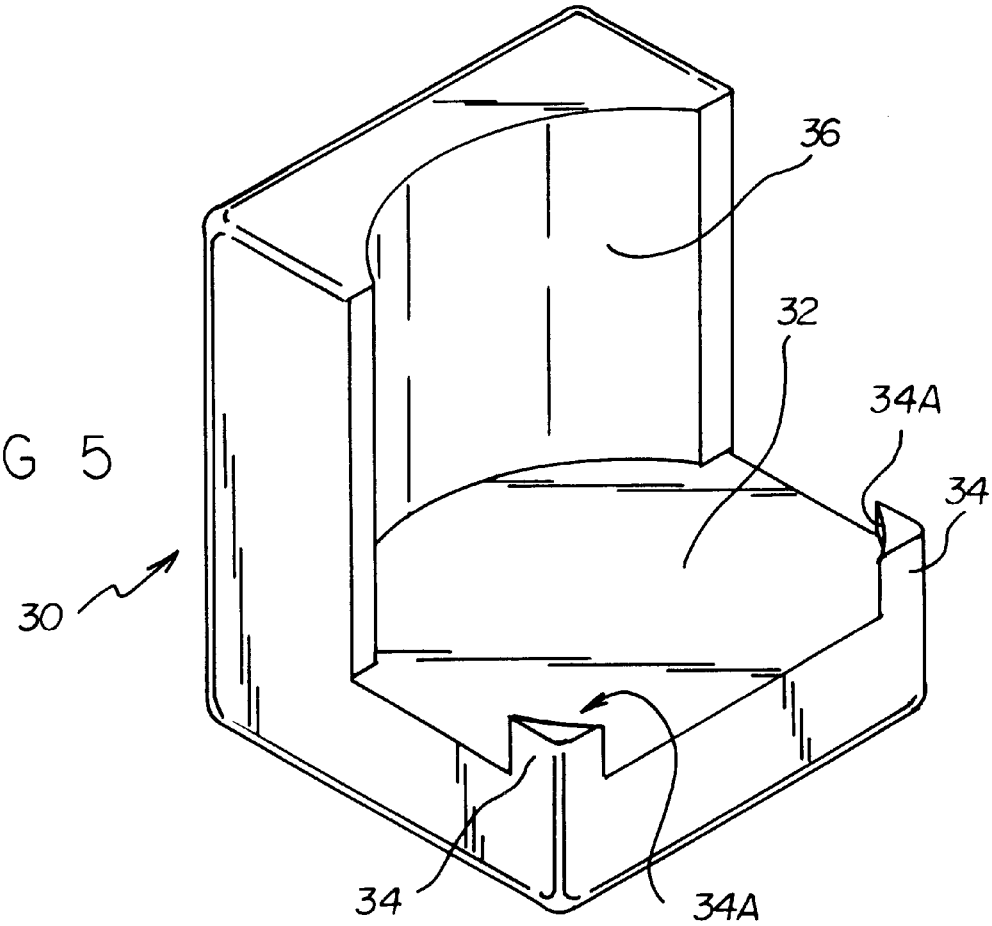
FIG. 5 is a perspective view of the dispenser.

With reference now to the drawings, and in particular to FIGS. 1 through 5 thereof, a new beverage coaster and dispenser embodying the principles and concepts of the present invention and generally designated by the reference numeral 10 will be described.

As best illustrated in FIGS. 1 through 5, the beverage coasters and dispenser 10 comprises a number of planar discs 12 formed into a stack by placing each planar disc 12 on top of an adjacent disc 12. Each planar disc 12 further includes a top face 14 and a bottom face 16. An adhesive strip 18 is positioned on each bottom face 16. The adhesive strip 18 is of the type providing repetitive adhesion while providing sufficient adhesive strength to overcome the pulling force created between the bottom of a beverage container and the top face 14 of the planar disc 12. The adhesive strip 18 is preferably formed into an arcuate strip having an arc between about 45 degrees and 225 degrees. The adhesive strip 18 is further positioned proximate an outer perimeter edge 20 of each bottom face 16.

The dispenser 30 includes a support surface 32, an arcuate back wall 36, and two stabilizing protrusions 34. The stabilizing protrusions 34 are located at respective forward corners of the dispenser 30. The arcuate back wall 36 extends upwardly from the support surface 32 and is curved to conform generally to the outer perimeter edge 20 of each planar disc 12. The stabilizing protrusions further include arcuate support walls 34A generally facing the arcuate back wall 36. Arcuate support walls 34A are also curved to generally conform to the outer perimeter edge 20 of each planar disc 12.

When a stack of planar discs 12 are placed in the dispenser 30, the adhesive strip 18 of the bottommost planar disc 12A removably adheres to support surface 32 of the dispenser 30. Alternately, a planar disc 12 without the adhesive strip 18 or a similarly shaped backer can be used such that the weight of the stack of planar discs 12 holds the stack within the dispenser 30. Yet another alternate method to prevent the bottommost planar disc 12A from adhering to the dispenser 30 is to utilize a cover over the adhesive strip 18 of the bottommost planar disc 12A. The cover can conform to the shape of the adhesive strip 18 or otherwise provide sufficient area such that adhesive strip 18 is substantially covered.

In a most preferred embodiment, the diameter of each planar disc 12 is about 4.25 inches and the thickness of each planar disc is about 0.03125 inches.

In use, the uppermost planar disc 12B is removable from the stack of planar discs 12. A user can grasp a portion of the outer perimeter edge 20 of the uppermost disc 12B and lift it away from the adjacent planar disc 12. The bottom face of the planar disc 12A can then be placed against a surface such that the adhesive strip 18 holds the planar disc 12A sufficiently to the surface to prevent unintentional removal of the planar disc 12A by the pulling force created between the bottom of a beverage container and the top face 14 of the planar disc 12A.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A beverage coaster for removably adhering to a surface such that said beverage coaster does not stick to a beverage container due to condensation collected around a lower perimeter edge of the beverage container, said beverage coaster comprising:

a substantially planar disc having an upper face and a lower face, said upper face and said lower face being substantially parallel with respect to each other, said upper face being adapted to support the beverage container;

an adhesive positioned on a first portion of said lower face, said adhesive being adapted for removably securing said lower face to the surface whereby said beverage coaster does not stick to the beverage container due to condensation collected around the lower perimeter edge of the beverage container;

wherein a second portion of said lower face is free of adhesive such that said planar disc is adapted for permitting insertion of a finger of a user between said lower face of said planar disc and the surface for facilitating removal of said planar disc from said surface after use.

wherein said said first portion of said lower face defines an arcuate strip, said arcuate strip being located proximate an outer perimeter of said lower face for positioning said arcuate strip at a location generally corresponding to the lower peripheral edge of a beverage container placed on said upper face; and wherein said arcuate strip of said first portion has an arc of between about 45 decrees and about 225 degrees.

2. The beverage coaster of claim 1, wherein said first portion of said lower face is confined to one side of a diameter line of said lower face of said planar disc such that the second portion comprises at least half of the lower face for lifting by a finger inserted beneath said lower face.

3. The beverage coaster of claim 1, wherein each planar disc has a diameter of about 4.25 inches.

4. The beverage coaster of claim 1, wherein in each planar disc has a thickness of about 0.03125 inches.

5. The beverage coaster of claim 1, further comprising:

a backing, said backing being provided between said adhesive strip and said lower face, said backing being secured to said lower face.

6. A beverage coaster dispenser assembly comprising:

a plurality of substantially planar discs, each planar disc having an upper face and a lower face, each said upper face and each said lower face of each respective planar disc being substantially parallel with respect to each other, each said upper face being adapted to support a beverage container;

an adhesive positioned on a first portion of each said lower face, said adhesive being adapted for removably securing said lower face to a surface whereby said planar disc does not stick to the beverage container due to condensation collected around a lower perimeter edge of the beverage container;

wherein a second portion of each said lower face is free of adhesive such that each said beverage coaster is adapted for permitting insertion of a finger of a user between said lower face of each said planar disc and the surface for facilitating removal of each said beverage coaster from said surface;

said adhesive further being for removably securing each said lower face to said upper face of an adjacent planar disc when said plurality of discs are stacked one on top of another to form a stack of planar discs;

a dispenser, said dispenser being for holding said stack of planar discs such that a top disc of said stack of planar discs is accessible to a user:

wherein said dispenser includes a support face for supporting said stack of planar discs;

an arcuate back wall, said arcuate back wall extending upwardly from a perimeter edge of said support face, said arcuate back wall having a curvature generally conforming to the outer perimeter edge of each said planar disc; and a pair of stabilizing support protrusions fixedly coupled to said support face, each of said pair of stabilizing protrusions extending upwardly from said support face, each of said pair of stabilizing support protrusions further being positioned proximate a respective forward corner of said dispenser.

7. The beverage coaster dispenser assembly of claim 6 further including a backing, said backing being provided between said adhesive strip and said lower face, said backing being secured to said lower face.

8. The beverage coaster dispenser assembly of claim 6, wherein each of said pair of stabilizing protrusions includes an arcuate inner face, said arcuate inner face generally conforming to the outer perimeter edge of each of said planar discs such that said stack of planar discs is positionable between said pair of stabilizing protrusions and said arcuate back wall.

9. A beverage coaster for removably adhering to a surface such that said beverage coaster does not stick to a beverage container due to condensation collected around a lower perimeter edge of the beverage container, said beverage coaster comprising:

a substantially planar disc having an upper face and a lower face, said upper face and said lower face being substantially parallel with respect to each other, said upper face being adapted to support the beverage container;

an adhesive positioned on a first portion of said lower face, said adhesive being adapted for removably securing said lower face to the surface whereby said beverage coaster does not stick to the beverage container due to condensation collected around the lower perimeter edge of the beverage container;

wherein a second portion of said lower face is free of adhesive such that said planar disc is adapted for permitting insertion of a finger of a user between said lower face of said planar disc and the surface for facilitating removal of said planar disc from said surface after use; and wherein said first portion of said lower face is confined to one side of a diameter line of said lower face of said planar disc such that the second portion comprises at least half of the lower face for lifting by a finger inserted beneath said lower face.

10. The beverage coaster of claim 9, further including a backing said backing being provided between said adhesive strip and said lower face, said backing being secured to said lower face.

* * * * *